US005687431A

United States Patent [19]

Garrett

[11] Patent Number: 5,687,431

[45] Date of Patent: Nov. 18, 1997

[54] TOILET TRANSFER BENCH

[76] Inventor: David Allen Garrett, 2851 Elderwood Rd., Salem, Va. 24153

[21] Appl. No.: 524,844

[22] Filed: Sep. 7, 1995

[51] Int. Cl.[6] ..... E03D 11/00

[52] U.S. Cl. ..... 4/254; 4/237

[58] Field of Search ..... 4/235, 237, 239, 4/667, 254, 480

[56] References Cited

U.S. PATENT DOCUMENTS

| | | | |
|---|---|---|---|
| 1,923,482 | 8/1933 | Frankenstein | 155/36.5 |
| 2,670,029 | 2/1954 | Rossi | 155/36.5 |
| 2,752,610 | 7/1956 | Mabrey | 4/237 |
| 3,209,375 | 10/1965 | Parsons | 4/254 X |
| 4,087,127 | 5/1978 | Lotta | 297/14 |
| 4,939,799 | 7/1990 | Van Hovel | 4/578 |
| 5,048,132 | 9/1991 | Rizzo | 4/578 |
| 5,185,892 | 2/1993 | Mitchell | 4/578.1 |
| 5,329,645 | 7/1994 | Fossum et al. | 4/254 |

FOREIGN PATENT DOCUMENTS

| | | | |
|---|---|---|---|
| 2337391 | 2/1974 | Germany | 4/254 |
| 3607310 | 3/1988 | Germany | 4/480 |
| 0001394 | 1/1913 | United Kingdom | 4/237 |

*Primary Examiner*—Charles E. Phillips
*Attorney, Agent, or Firm*—Kenyon & Kenyon

[57] ABSTRACT

A toilet transfer bench has a platform that is attached with hinges to the wall behind an existing toilet. The platform can be folded down over existing toilets to facilitate their use by persons in wheelchairs or by persons with limited mobility. The platform is supported over the existing toilet seat by hinged legs which fold back against the platform when the toilet transfer bench is folded up against the wall. An opening is provided in the platform that generally corresponds in size and shape to the toilet seat over which the platform is positioned.

2 Claims, 2 Drawing Sheets

TOILET TRANSFER BENCH

BACKGROUND OF THE INVENTION

The present invention relates generally to transfer benches and more particularly to a toilet transfer bench having an extended surface area for facilitating the use of toilets by persons in wheelchairs or with limited mobility.

A typical handicap stall in a public restroom is equipped with a toilet and with handrails located on the side walls to assist a wheelchair user in transferring from the wheelchair to the toilet seat. Since a wheelchair approaches straight into the stall, it ends up facing the toilet. This requires that the wheelchair user stand up and turn around to mount the toilet. Although some wheelchair users have sufficient maneuverability to make this transfer, many wheelchair users have total paralysis of the lower extremities and experience great difficulty in transferring from the wheelchair to the toilet. In addition, the narrow width of the toilet seat makes it extremely difficult for the user to undress, redress, clean or perform bowel programs such as suppositories since there is insufficient surface area on which to roll or slide. There is also insufficient safe surface area to permit someone to assist the user in these activities.

Some effort has been made to assist users who must assume a recumbent or reclined position when using a toilet. U.S. Pat. No. 2,752,610 issued to Mabrey (hereinafter "Mabrey") in 1956 and entitled "Toilet Seat" discloses a toilet seat which can be attached to a conventional toilet bowl and permits a user assume a recumbent or reclined position. The device includes an auxiliary seat which is placed on the toilet bowl rim. Attached to the front of the auxiliary seat is an essentially coplanar back rest which extends out from the front of the toilet. This arrangement permits a user to sit astride the annular seat and recline on the back rest. However, this apparatus does not allow a wheelchair to be positioned next to the toilet, nor does it provide any surface support on either side area of the toilet.

The present invention is directed to a toilet transfer bench having an extended surface area on both sides of a toilet seat, thereby permitting unobstructed access to the toilet by wheelchair users and providing a surface which facilitates dressing, redressing, cleaning and other hygienic or medical activities.

SUMMARY OF THE INVENTION

The present invention overcomes many of the problems discussed above with respect to providing a suitable toilet transfer bench. In particular, a feature of the invention which overcomes these problems is a platform support surface with an opening sized to generally correspond to the opening of a toilet seat. The platform is attached to the wall behind the toilet so the toilet transfer bench can fold up for storage and fold down when in use. The platform has a horseshoe opening which will be flush with the outer edge of the existing toilet seat when the height of the platform is the same height as the toilet seat. If the height of the toilet seat is less than the height of the platform, the platform has a tear-drop hole cut in it. When the platform is folded down over the toilet seat, it is supported by legs at or near the front edge of the platform. These legs are hinged so that they fold flat against the bottom of the support surface when the bench is folded up against the wall.

The toilet transfer bench permits a wheelchair to be positioned close to the front of the toilet. The bench is attached in a fold-up manner to the wall behind the toilet, making it easily accessible for wheelchair users, but also permitting the toilet to be used without the transfer bench. The extended surface area of the transfer bench on both sides of the toilet provides sufficient support area to enable a user to dress or perform hygienic or medical activities which might not otherwise be possible using toilets with conventional toilet seats. The extended side surface area also permits a wheelchair user to use a half-moon slide around to mount the toilet, rather than being required to stand up and turn around.

Other advantages of the invention will be readily understood from the following description of the invention and the accompanying drawings.

DETAILED DESCRIPTION

Figure 1:
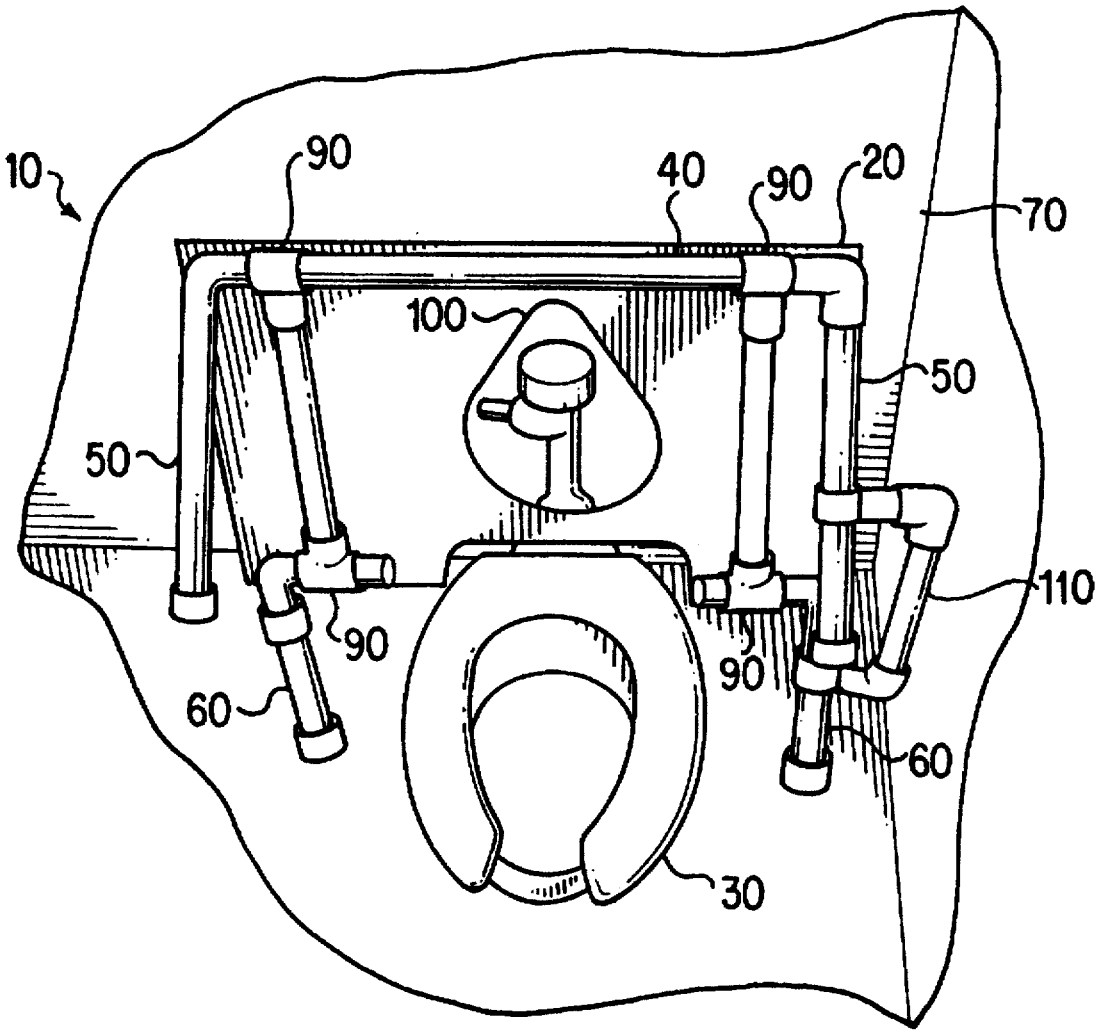
FIG. 1 is a schematic illustration of a toilet transfer bench having a tear-drop shaped opening and in the folded up position, constructed according to the principles of the present invention.
Figure 2:
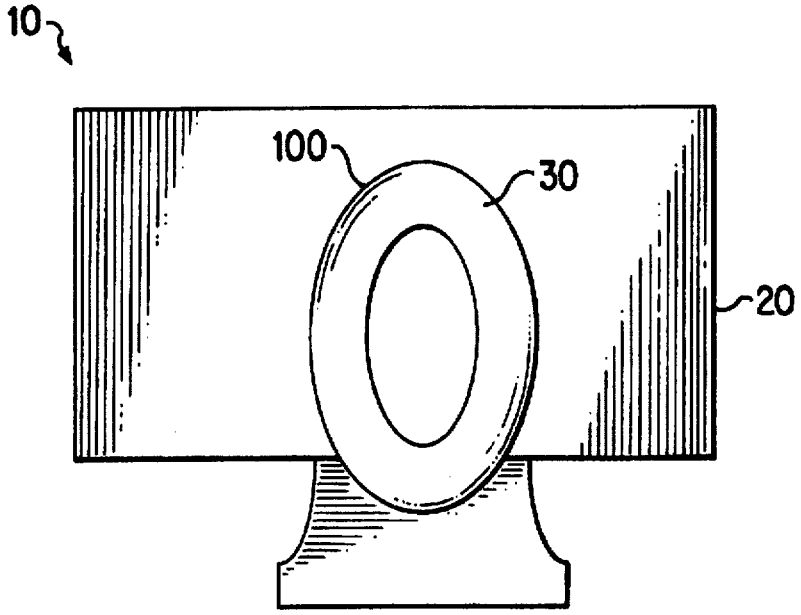
FIG. 2 is a top view another embodiment of the present invention having a horseshoe-shaped opening.
Figure 3:
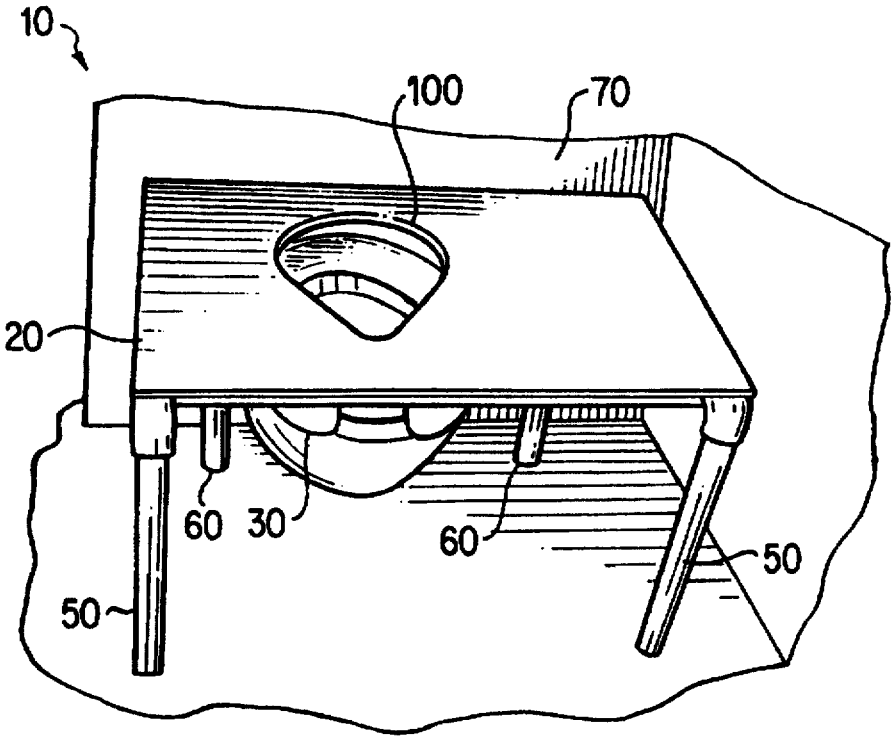
FIG. 3 is a top view of another embodiment of the present invention in the folded down position.

Referring to FIG. 1, the toilet transfer bench 10 includes a rigid planar platform 20 capable of supporting the weight of a user. The platform is supported on a frame 40 above a toilet seat by front 50 and rear legs 60 and is connected to a wall 70 behind the toilet seat 30 by hinges (not shown). The wall hinge connection permits the toilet transfer bench 10 to be folded up against the wall 70 when not in use. The legs 50, 60 are connected to the platform 20 by hinges 90 which permit the legs 50, 60 to fold flat when the platform 20 is folded up against the wall 70. The platform 20 has an opening 100 generally corresponding in size and location to the opening of the toilet seat 30 below, when the toilet transfer bench 10 is folded down over the toilet. Referring to FIG. 2, when the toilet transfer bench 10 is positioned at a height corresponding to the height of the existing toilet seat 30, the opening 100 in the platform 20 is horseshoe-shaped and open at the rear. When the platform 20 height is higher than the existing toilet seat 30, the opening 100 in the platform 20 is generally teardrop-shaped to conform to the shape of the toilet seat 30 below, as shown in FIGS. 1 and 3. The front edge of the platform 20 surface extends a short distance beyond the front edge of the existing toilet seat 30 and the rear edge of the platform. The side edges of the platform 20 extend well beyond the edges of the existing toilet seat 30 in order to provide sufficient surface to enable a user to slide onto the platform and to provide enough surface to facilitate undressing, dressing and other hygienic or medical activities. For example, a width of 30 inches and a length of 20 inches have been found to work well. Although the dimensions of the platform may vary, the width of the platform 20 may be restricted by the width of the room or the stall in which the toilet is located.

The frame 40 and the legs 50, 60 of the toilet transfer bench 10 are made of PVC pipe and the platform 20 is made of a solid plastic such as polystyrene. When PVC pipe is used, a slip T type connection may be used to form the hinge connection of the legs to the frame. It may also be advantageous to pivotally connect the front and rear legs with a bar member 110, as shown in FIG. 1 so the legs move in tandem, with a generally scissoring motion, when the toilet transfer bench is folded up or down from the wall. The platform 20 may also be padded to make it more comfortable. In addition, for added stability, the rear legs may be screwed, bolted or otherwise securely attached to the floor Although only a few embodiments have been described in detail above, those having ordinary skill in the art will certainly understand that many modifications are possible in the preferred embodiment without departing from the teachings thereof. For example, the platform may be mounted directly to the legs, without the need for a frame. In addition, the frame, platform and legs can be any of a number of well known materials which have sufficient strength to support the weight of a user. Such materials include, but are not limited to plastic, wood, metal and composites. In addition, although the preferred embodiment has been described in terms of a hinged platform attached to the wall behind the toilet, the toilet transfer bench could also be hingedly attached to a wall at the side of the toilet. The toilet transfer bench can also be made with legs that are not hinged, and the bench can be made as a freestanding unit that is not attached to a wall. In addition, the opening in the platform can be a variety of configurations that generally correspond to the opening of the toilet seat or toilet bowl over which the toilet transfer bench is positioned and as long as the configuration does not interfere with positioning the toilet transfer bench over the existing toilet. All such modifications are intended to be encompassed within the following claims.

What is claimed is:

1. A toilet transfer bench for use over existing toilets which are attached at the back of the toilet to a wall, the toilet having a toilet seat, wherein the toilet transfer bench comprises:

a rigid platform including a back edge, a front edge and two side edges, wherein the back edge of the platform is hingedly connected to the wall behind the existing toilet, the platform having an opening generally corresponding in location and size to the opening of the existing toilet seat when the toilet transfer bench is positioned over the existing toilet, the width of the platform being sufficient to permit a user to slide onto the platform and to roll to facilitate dressing and personal hygiene;

a plurality of vertical legs attached at the top of each leg near the front edge of the platform, wherein the height of each leg attached near the front edge of the platform is sufficient to support the platform at a height that is at least as high as the height of the toilet seat;

a plurality of vertical legs attached at the top of each leg near the back edge of the platform, wherein the vertical legs attached near the front and back edges of the platform are hingedly attached to the platform; and a bar member pivotally connected to the front and back legs at one side edge of the rigid platform.

2. A toilet transfer bench for use over existing toilets which are attached at the back of the toilet to a wall, the toilet having a toilet seat, wherein the toilet transfer bench comprises:

a rigid platform including a back edge, a front edge and two side edges, wherein the back edge of the platform is hingedly connected to the wall behind the existing toilet, the platform having an opening generally corresponding in location and size to the opening of the existing toilet seat when the toilet transfer bench is positioned over the existing toilet, the width of the platform being sufficient to permit a user to slide onto the platform and to roll to facilitate dressing and personal hygiene;

a plurality of vertical legs attached at the top of each leg near the front edge of the platform, wherein the height of each leg is sufficient to support the platform at a height greater than the height of the toilet seat and wherein the opening in the platform is teardrop-shaped;

a plurality of legs attached at the top to the back edge of the platform, wherein the legs attached to the front and back edges of the platform are hingedly attached to the platform; and a bar member pivotally connected to the front and back legs at one side edge of the rigid platform.

* * * * *